US005296440A

United States Patent [19]

Kanda et al.

[11] Patent Number: 5,296,440

[45] Date of Patent: Mar. 22, 1994

[54] HEAT-SENSITIVE RECORDING MEDIUM

[75] Inventors: Nobuo Kanda, Neyagawa; Naoto Arai, Ikeda; Tosaku Okamoto, Osaka; Isamu Nakano, Takatsuki; Tetsuo Tsuchida, Takarazuka, all of Japan

[73] Assignee: Kanzaki Paper Manufacturing Co., Ltd., Japan

[21] Appl. No.: 859,370

[22] PCT Filed: Sep. 27, 1991

[86] PCT No.: PCT/JP91/01291

§ 371 Date: May 26, 1992

§ 102(e) Date: May 26, 1992

[87] PCT Pub. No.: WO92/05963

PCT Pub. Date: Apr. 16, 1992

[30] Foreign Application Priority Data

| | | | |
|---|---|---|---|
| Sep. 29, 1990 | [JP] | Japan | 2-261236 |
| Dec. 27, 1990 | [JP] | Japan | 2-408460 |
| Feb. 1, 1991 | [JP] | Japan | 3-012176 |

[51] Int. Cl.[5] ..... B41M 5/30

[52] U.S. Cl. ..... 503/208; 503/209; 503/225

[58] Field of Search ..... 503/208, 209, 207, 215, 503/225

[56] References Cited

U.S. PATENT DOCUMENTS

| | | | |
|---|---|---|---|
| 3,937,864 | 2/1976 | Kohmura et al. | 427/150 |
| 4,473,831 | 9/1984 | Watanabe | 503/209 |
| 4,771,033 | 9/1988 | Shimizu et al. | 503/209 |
| 5,175,138 | 12/1992 | Akutsu et al. | 503/209 |

FOREIGN PATENT DOCUMENTS

| | | | |
|---|---|---|---|
| 0464502 | 1/1992 | European Pat. Off. | 503/209 |
| 3942137 | 6/1990 | Fed. Rep. of Germany | 503/209 |
| 2503729 | 10/1982 | France | 503/208 |
| 58-138690 | 8/1983 | Japan | 503/209 |
| 58-179689 | 10/1983 | Japan | 503/209 |
| 62-90284 | 4/1987 | Japan | 503/209 |

*Primary Examiner*—Pamela R. Schwartz
*Attorney, Agent, or Firm*—Larson and Taylor

[57] ABSTRACT

The invention provides a heat-sensitive recording medium comprising (a) a support and (b) a heat-sensitive recording layer formed on the support and comprising a colorless or pale-colored basic dye and a color developing material capable of causing color development upon contact with the dye by heating, which medium is characterized in that the heat-sensitive recording layer contains at least one phosphate compound selected from the group consisting of 2,2'-methylenebis(4,6-di-tert-butylphenyl) phosphate of the general formula (1) shown below and alkali metal, ammonium and polyvalent metal salts thereof:

(1)

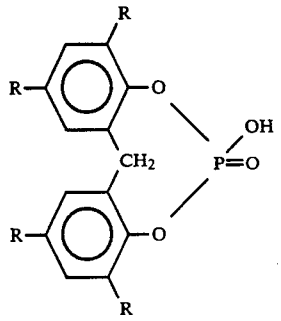

wherein R represents a tert-butyl group.

13 Claims, No Drawings

HEAT-SENSITIVE RECORDING MEDIUM

TECHNICAL FIELD

The present invention relates to heat-sensitive recording media and, more particularly, to heat-sensitive recording media excellent in storage stability of record images.

BACKGROUND ART

Heat-sensitive recording media are well known in the art which make use of the reaction between a colorless or pale-colored basic dye and a color developing material and give images upon application of heat which brings the color developing material into contact with the basic dye. Such heat-sensitive recording media have the drawback that record images generally have insufficient storage stability and become faded with the lapse of time. Particularly when heat-sensitive recording media are stored under high humidity and/or high temperature conditions, record images may fade away in a relatively short period of time. Improvement in this respect is earnestly desired.

For improving the storage stability of record images, various heat-sensitive recording media containing a storage stability improving agent or agents have been proposed. However, the improvement in storage stability is generally compromised by newly accompanying drawbacks such as reduced whiteness and adhesion of residual substances to the thermal head. Thus, the results are not invariably satisfactory.

DISCLOSURE OF THE INVENTION

With the above situation in view, the present inventors conducted intensive investigations on storage stability improving agents to be contained in the recording layer. As a result, we found that 2,2'-methylenebis(4,6-di-tert-butylphenyl) phosphate, an alkali metal salt thereof, an ammonium salt thereof, polyvalent metal salt thereof, or a mixture of these, when contained, in the recording layer, give heat-sensitive recording media excellent in storage stability of record images without accompanying any new drawback. The present invention has now been completed based on this finding.

The present invention thus provides a heat-sensitive recording medium comprising (a) a support and (b) a heat-sensitive recording layer formed on the support and comprising a colorless or pale-colored basic dye and a color developing material capable of causing color development upon contact with the dye by heating, which medium is characterized in that said heat-sensitive recording layer contains at least one phosphate compound selected from the group consisting of 2,2'-methylenebis(4,6-di-tert-butylphenyl) phosphate of the general formula (1) shown below and alkali metal, ammonium and polyvalent metal salts thereof:

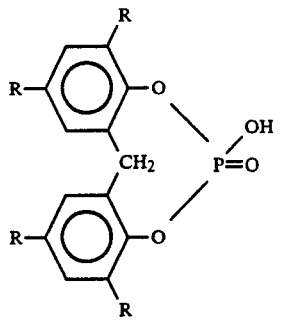

(1)

wherein each R represents a tert-butyl group.

In an embodiment of the invention, the heat-sensitive recording layer contains at least one of 2,2'-methylenebis(4,6-di-tert-butylphenyl) phosphate represented by the above general formula (1) and alkali metal and ammonium salts thereof.

In another embodiment of the invention, the above-mentioned heat-sensitive recording layer contains at least one of polyvalent metal salts of 2,2'-methylenebis(4,6-di-tert-butylphenyl) phosphate.

The above-mentioned embodiments of the invention are described below in further detail.

EMBODIMENT (I)

In one embodiment of the invention, the heat-sensitive recording layer contains at least one phosphate compound selected from among 2,2'-methylenebis(4,6-di-tert-butylphenyl) phosphate represented by the above general formula (1) and alkali metal and ammonium salts thereof. Preferably, the heat-sensitive recording layer mentioned above contains at least one of 2,2'-methylenebis(4,6-di-tert-butylphenyl) phosphate and alkali metal salts thereof.

The heat-sensitive recording medium in this embodiment is excellent in storage stability of record images and, in addition, is resistant to fogging , thus generally featuring a high level of whiteness of the heat-sensitive recording layer.

As specific examples of the compound of the above general formula (1) and of alkali metal and ammonium salts thereof, there may be mentioned, for example, 2,2'-methylenebis(4,6-di-tert-butylphenyl) phosphate, sodium salt of 2,2'-methylenebis(4,6-di-tert-butylphenyl) phosphate, potassium salt of 2,2'-methylenebis(4,6-di-tert-butylphenyl) phosphate and ammonium salt of 2,2'-methylenebis(4,6-di-tert-butylphenyl) phosphate. It is of course possible to use these compounds in the form of a mixture of two or more of them as necessary. The particle size of the above-mentioned compound of general formula (1) or the alkali metal salt or ammonium salt thereof is not specifically limited but it is desirable to subject, as necessary, said compound or salt to wet grinding, for instance, to an average particle size of about 0.1 to 10 μm, preferably about 0.1 to 3 μm.

It is further possible to add these compounds to a coating composition for heat-sensitive recording layer formation after preliminary adsorption thereof on an inorganic pigment, such as talc, clay, kaolin or silica, or after blending thereof with such an inorganic pigment.

When at least one of the above-mentioned 2,2'-methylenebis(4,6-di-tert-butylphenyl) phosphate and alkali metal and ammonium salts thereof is(are) used in the form adsorbed on or admixed with the above-mentioned inorganic pigment, the proportions of both are not particularly limited. It is desirable, however, that the proportions of (A) at least one of the above-mentioned 2,2'-methylenebis(4,6-di-tert-butylphenyl) phosphate and alkali metal and ammonium salts thereof and (B) the inorganic pigment is adjusted to give an A:B weight ratio within the range of about 80:20 to 20:80, particularly within the range of about 70:30 to 30:70. For effecting adsorption of at least one of the above-mentioned compound of general formula (1) and alkali metal and ammonium salts thereof on an inorganic pigment, any of various conventional methods may be used. Thus, for example, said adsorption may be effected by dissolving at least one of the compound of general formula (1) and alkali metal and ammonium salts thereof in a small amount of a solvent, such as, methanol, admixing the solution with an inorganic pigment and drying the mixture, followed by pulverizing when necessary. The particle size of the inorganic pigment mentioned above is not particularly limited but, generally, the mean particle size is preferably about 0.05 to 15 μm. Where the phosphate compound is used as absorbed on or blended with an inorganic pigment, it is also preferable that it is pulverized as necessary by wet pulverization for instance, to a mean particle size of about 0.1 to 10 μm, preferably about 0.1 to 3 μm.

The amount of at least one of the above-mentioned 2,2'-methylenebis(4,6-di-tert-butylphenyl) phosphate and alkali metal and ammonium salts thereof to be used is not specifically limited. Generally, however, said amount is preferably within the range of about 1 to 300 parts by weight, more preferably about 1 to 100 parts by weight, per 100 parts by weight of the color developing material.

EMBODIMENT (II)

In another embodiment of the invention, the above-mentioned heat-sensitive recording layer contains at least one of polyvalent metal salts of 2,2'-methylenebis(4,6-di-tert-butylphenyl) phosphate. The heat-sensitive recording medium in this embodiment is excellent in storage stability of record images and, in addition, has characteristic features that it is resistant to fogging and, in particular, causes less degree of adhesion of residual substances.

The polyvalent metal salts mentioned above are not particularly limited in particle size but, generally, the mean particle size thereof is preferably about 0.1 to 10 μm, more preferably about 0.1 to 3 μm. As metals constituting such polyvalent metal salts, there may be mentioned zinc, magnesium, barium, calcium, aluminum, tin, titanium, nickel, cobalt, manganese and iron, among others.

Such polyvalent metal salts of 2,2'-methylenebis-(4,6-di-tert-butylphenyl) phosphate can be prepared by various methods. Mention may be made of, for instance, (i) the method comprising reacting an alkali metal salt of 2,2'-methylenebis(4,6-di-tert-butylphenyl) phosphate with a water-soluble salt containing a polyvalent metal as mentioned above in water to thereby effect salt exchange and (ii) the method comprising subjecting at least one of 2,2'-methylenebis(4,6-di-tert-butylphenyl) phosphate and alkali metal salts thereof together with a polyvalent metal compound to dry or wet pulverization to thereby effect salt exchange.

As the polyvalent metal compound that can be used in the above-mentioned method (ii), there may be mentioned an oxide, hydroxide, sulfide, halide, carbonate, phosphate, silicate, sulfate, nitrate or aluminate of a polyvalent metal selected from the group consisting of zinc, magnesium, barium, calcium, aluminum, tin, titanium, nickel, cobalt, manganese and iron, silica surface-treated with a substance containing said polyvalent metal, higher fatty acid salts of said polyvalent metal, and mixtures of two or more of these compounds.

More specifically, the following examples may be given: (a) zinc oxide, zinc hydroxide, zinc sulfide, zinc chloride, zinc carbonate, zinc phosphate, zinc silicate, zinc sulfate, zinc nitrate, zinc aluminate, magnesium oxide, magnesium hydroxide, magnesium sulfide, magnesium chloride, magnesium carbonate, magnesium phosphate, magnesium silicate, magnesium sulfate, magnesium nitrate, magnesium aluminate, barium chloride, barium carbonate, barium sulfate, calcium oxide, calcium hydroxide, calcium chloride, calcium carbonate, calcium silicate, aluminum oxide, aluminum hydroxide, aluminum phosphate, aluminum silicate, titanium oxide, etc., (b) silica surface-treated with a substance containing a polyvalent metal such as zinc, magnesium, barium, calcium or aluminum, for example calcium carbonate or aluminum oxide, and (c) polyvalent metal salts of higher fatty acids, in particular $C_{10}$–$C_{20}$ higher fatty acids, for example zinc stearate, magnesium stearate, barium stearate, calcium stearate and aluminum stearate.

Among these preparation methods, the above-mentioned method (ii) is preferred since the polyvalent metal salt of 2,2'-methylenebis(4,6-di-tert-butylphenyl) phosphate as prepared can efficiently be pulverized simultaneously. In particular, the method (ii) in which wet pulverization is employed is more preferred since the salt exchange progresses smoothly and more uniform pulverization can be achieved.

Such wet pulverization may be carried out in the presence of water in a conventional grinding apparatus, for example a sand mill, using 100 parts by weight of at least one of the above-mentioned 2,2'-methylenebis(4,6-di-tert-butylphenyl) phosphate and alkali metal salts (sodium salt etc.) thereof together with 1 to 500 parts by weight of a polyvalent metal compound, to a particle size of about 0.1 to 10 μm, preferably about 0.1 to 3 μm.

In carrying out wet pulverization, sulfone group-modified polyvinyl alcohol is preferably used as a dispersion aid since the use thereof makes it possible to conduct the pulverization treatment efficiently and, as a result, produce heat-sensitive recording media excellent in storage stability of record images and causing lesser degree of adhesion of residual substances.

Such sulfone group-modified polyvinyl alcohol is a per se known compound. It is prepared, for instance, by saponifying a copolymer of vinyl acetate and an olefin-sulfonic acid, such as ethylenesulfonic acid, allylsulfonic acid or methallylsulfonic acid, or a salt (e.g. sodium salt}thereof or by treating polyvinyl alcohol with bromine or the like, followed by heating in an aqueous solution of sodium hydrogen sulfite. It contains, within the molecule thereof, the sulfonic acid group and/or a salt (e.g. alkali metal salt such as sodium salt) thereof. A sulfone group-modified polyvinyl alcohol species having a degree of modification (proportion of monomer units containing the sulfonic acid group or a salt thereof to all monomer units) of about 1 to 10 mole percent, a degree of saponification of about 60 to 100 mole percent and a degree of polymerization of about 100 to 1,000 is preferred. Such sulfone group-modified polyvinyl alcohol is used preferably in an amount within the range of about 0.05 to 50 parts by weight, more preferably about 0.5 to 25 parts by weight, per 100 parts by weight of at least one of 2,2'-methylenebis(4,6-di-tert-butylphenyl) phosphate and alkali metal salts thereof.

In this embodiment, the use of a polyvalent metal salt mixture comprising two or more different metal species is particularly preferred since said use leads to production of particularly good results in achieving the desired performance characteristics to be attained according to the invention.

Among the polyvalent metal salts mentioned above, those polyvalent metal salts in which the polyvalent metal is magnesium, calcium, barium, zinc or aluminum are particularly preferred.

The amount of at least one of the polyvalent metal salts of the compound of general formula (1) which is to be used is not limited but, generally, it is preferably within the range of about 1 to 300 parts by weight, more preferably about 1 to 100 parts by weight, per 100 parts by weight of the color developing material.

The other components or ingredients to be contained in the heat-sensitive recording layer of the present invention are described in the following. The description which follows applies to either of the above-mentioned embodiments (I) and (II).

In the invention, the colorless or pale-colored basic dye, which is a constituent of the recording layer, may be any of various known dyes conventionally used in this field of art, inclusive of the following examples: triarylmethane dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide and -p-dimethylaminophenyl-3-(1-methylpyrrol-3-yl)-6-dimethylaminophthalide, diphenylmethane dyes such as 4,4'-bis-dimethylaminobenzhydryl benzyl ether, N-halophenyl-leucoauramine and N-2,4,5-trichlorophenylleucoauramine, thiazine dyes such as benzoylleucomethylene blue and p-nitrobenzoylleucomethylene blue, spiro dyes such as 3-methyl-spirodinaphthopyrane, 3-ethyl-spiro-dinaphthopyrane, 3-phenyl-spirodinaphthopyrane, 3-benzyl-spiro-dinaphthopyrane, 3-methyl-naphtho-(6'-methoxybenzo)spiropyrane and 3-propylspiro-dibenzopyrane, lactam dyes such as rhodamine-B-anilinolactam, rhodamine (p-nitroanilino)lactam and rhodamine (o-chloroanilino)-lactam, and fluoran dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)-fluoran, 3-dimethylamino-6-methyl-7-phenylaminofluoran, 3-diethylamino-6-methyl-7-phenylaminofluoran, 3-di-n-butylamino-6-methyl-7-phenylaminofluoran, 3-di-n-pentylamino-6-methyl-7-phenylaminofluoran, 3-diethylamino-7-(2-carbomethoxyphenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-di-n-butylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl)amino-6-methyl-7-phenylaminofluoran, 3-(N-ethyl-N-tetrahydrofurfuryl)amino-6-methyl-7-phenylaminofluoran, 3-(N-ethyl-N-cyclopentyl)amino-6-methyl-7-phenylaminofluoran and 2,2-bis[4-[6'-(N-cyclohexyl)-N-methylamino)-3'-methylspiro(phthalide-3,9'-xanthen)-2'-ylamino]phenyl]propane, and the like. Of course these examples have no limitative meanings, and it is possible to use two or more dyes combinedly.

Among the dyes mentioned above, 3-di-n-butylamino-6-methyl-7-phenylaminofluoran and 3-di-n-butylamino-7-(o-chlorophenylamino)fluoran are preferred since they give heat-sensitive recording media featuring particularly high whiteness in white portions.

As for the color developing material to be used in combination with the above-mentioned basic dyes, various compounds conventionally used in this field of art may be used. Examples are as follows: phenolic compounds such as 4-tert-butylphenol, α-naphthol, β-naphthol, 4-acetylphenol, 4-tert-octylphenol, 4,4'-sec-butylidenediphenol, 4-phenylphenol, 4,4'-dihydroxydiphenylmethane, 4,4'-isopropylidenediphenol, hydroquinone, 4,4'-cyclohexylidenediphenol, 4,4'-(1,3-dimethylbutylidene)bisphenol, 2,2-bis(4-hydroxyphenyl)-4-methylpentane, 4,4'-dihydroxydiphenyl sulfide, 4,4'-thiobis(6-tert-butyl-3-methylphenol), 4,4'-dihydroxydiphenyl sulfone, 2,4'-dihydroxydiphenyl sulfone, 4-hydroxy-4'-methyldiphenyl sulfone, 4-hydroxy-4'-methoxydiphenyl sulfone, 4-hydroxy-4'-isopropoxydiphenyl sulfone, 4-hydroxy-3',4'-trimethylenediphenyl sulfone, 4-hydroxy-3',4'-tetramethylenediphenyl sulfone, 3,4-di-hydroxy-4'-methyldiphenyl sulfone, bis(3-allyl-4-hydroxyphenyl) sulfone, 1,3-di[2-(4-hydroxyphenyl)-2-propyl]benzene, hydroquinone monobenzyl ether, butyl bis(4-hydroxyphenyl)acetate, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak-type phenol resins, and phenol polymers, aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzyl)salicylic acid, 3-chloro-5-(α-methylbenzyl)salicylic acid, 3-phenyl-5-(α,α-dimethylbenzyl)salicylic acid, 3,5-di-α-methylbenzylsalicylic acid, 4-(2-p-methoxyphenoxyethoxy)salicylic acid, 4-(3-p-tolylsulfonylpropyloxy)salicylic acid and 5-[p-(2-p-methoxyphenoxyethoxy)cumyl]salicylic acid, salts of these phenolic compounds or aromatic carboxylic acids with polyvalent metals such as zinc, magnesium, aluminum, calcium, titanium, manganese, tin and nickel, and the like organic acidic substances. It is of course possible to use two or more of the above-mentioned color developing materials in combination, when required.

The proportions of the basic dye and color developing material are not particularly limited but should suitably be selected depending on the basic dye and/or color developing material employed. Generally, the color developing material is used in an amount of about 100 to 700 parts by weight, preferably about 150 to 400 parts by weight, per 100 parts by weight of the basic dye.

The heat-sensitive recording layer of the heat-sensitive recording medium of the present invention is formed by preparing a coating composition containing at least one of the compound of the above general formula (1) and alkali metal, ammonium and polyvalent metal salts thereof (hereinafter referred to as storage stability improving agent), a basic dye and a color developing material, applying the coating composition to a support, and drying the same.

The coating composition mentioned above is prepared in the conventional manner, in a stirring and pulverizing means such as a ball mill, attritor or sand mill, generally using water as a dispersion medium. The storage stability improving agent, basic dye and color developing material may be dispersed either simultaneously or separately.

A binder is generally incorporated in such coating composition. As the binder, those conventional in this field of art may be used, for example starches, hydroxyethylcellulose, methylcellulose, carboxymethylcellulose, gelatin, casein, gum arabic, polyvinyl alcohol, carboxyl group-modified polyvinyl alcohol, sulfone group-modified polyvinyl alcohol, silicon-modified polyvinyl alcohol, acetoacetyl group-modified polyvinyl alcohol, graft copolymers derived from a vinyl alcohol-vinyl acetate copolymer and acrylamide-acrylic acid-allyl acetoacetate, styrene-maleic anhydride copolymer salts, styrene-acrylic acid copolymer salts, and styrene-butadiene copolymer emulsions. In the above coating composition, these binders are incorporated generally in an amount of about 2 to 40% by weight, preferably about 5 to 25% by weight, based on the total solids in the coating composition.

Furthermore, various auxiliaries may be added to the coating composition. As the auxiliaries, there may be mentioned dispersants such as sodium dioctyl sulfosuccinate, sodium dodecylbenzenesulfonate, sodium salt of lauryl alcohol sulfate and fatty acid metal salts, antifoaming agents, fluorescent dyes, coloring dyes, etc.

For reducing adhesion of residual substances to the recording head, various pigments conventionally used in the field of heat-sensitive recording media may be added, for example inorganic pigments such as silicon oxide pigments, kaolin, clay, talc, calcium carbonate, magnesium carbonate, calcium silicate, magnesium silicate, calcined clay, titanium oxide, diatomaceous earth and activated clay, and organic pigments such as polystyrene microballs, nylon powders, polyethylene powders, urea-formalin resin fillers, and starch particles. These pigments are not specifically limited in particle size but, generally, they should preferably have a mean particle size of about 0.1 to 15 μm.

Among these various pigments, alkaline pigments such as calcium carbonate, magnesium carbonate, calcium silicate and magnesium silicate are preferred since, when they are used in combination with the storage stability improving agent such as the compound of general formula (1), heat-sensitive recording media showing a particularly reduced degree of fogging can be obtained. Among the alkaline pigments, calcium carbonate and magnesium carbonate are superior in that effect and, in particular, calcium carbonate is the most preferred because of its low cost. The amount of such an alkaline pigment is not specifically limited but preferably about 1 to 30% by weight and more preferably about 3 to 15% by weight based on the total solids contained in the coating composition for the formation of the heat-sensitive recording layer. It is of course possible to use any of these alkaline pigments in combination with other pigments mentioned hereinabove. When one or more alkaline pigments are used combinedly with one or more of said other pigments, the total amount of the pigments should preferably be controlled within the range of about 5 to 50% by weight based on the total solids content of the coating composition for heat-sensitive recording layer formation.

Furthermore, for preventing sticking due to contact with the recording device or recording head, any of stearic acid, polyethylene, carnauba wax, paraffin wax, zinc stearate, calcium stearate, ester wax and the like may be added in the form of a dispersion or emulsion.

In the heat-sensitive recording media of the present invention, there may be incorporated, within limits not detrimental to the anticipated effect of the invention, as a sensitizer, fatty acid amides such as stearamide, methylenebisstearamide, oleamide, palmitamide and coco fatty acid amide, hindered phenols such as 2,2'-methylenebis(4-methyl-6-tert-butylphenol), 4,4'-butylidenebis(6-tert-butyl-3-methylphenol), 1,1,3-tris(2-methyl-4-hydroxy-5-tert-butylphenyl)butane and 1,1,3-tris(2-methyl-4-hydroxy-5-cyclohexylphenyl)butane, biphenyls such as p-benzylbiphenyl and p-(4-tolyloxy)-biphenyl, ethers such as 1,5-bis(4-methoxyphenoxy)-3-oxa-pentane, 1,2-bis(phenoxy)ethane, 1,2-bis(4-methylphenoxy)ethane, 1,2-bis(3-methylphenoxy)ethane, 1-(2-methylphenoxy)-2-(4-methoxyphenoxy)ethane and 2-naphthyl benzyl ether, esters such as dibenzyl terephthalate, phenyl 1-hydroxy-2-naphthoate, dibenzyl oxalate, di(4-methylbenzyl) oxalate and di(4-chlorobenzyl) oxalate, ultraviolet absorbers such as 2-(2'-hydroxy-5'-methylphenyl)benzotriazole and 2-hydroxy-4-benzyloxybenzophenone, and other various known heat-fusible substances.

Among the heat-fusible substances mentioned above, 1,2-bis(3-methylphenoxy)ethane, 1,2-bis(phenoxy)-ethane, 1-(2-methylphenoxy)-2-(4-methoxyphenoxy)ethane, dibenzyl oxalate, di(4-methylbenzyl) oxalate, di(4-chlorobenzyl) oxalate, p-benzylbiphenyl, p-(4-tolyloxy)biphenyl and 1,5-bis(4-methoxyphenoxy)-3-oxa-pentane are preferred since they produce a particularly good sensitizing effect when used in combination with the above-mentioned specific storage stability improving agent. They may be used also in the form of a mixture of two or more of them, when necessary.

The amount of the heat-fusible substance, when such is used, is not critical but, generally, it is preferably within the range of 50 to 1,000 parts by weight, more preferably 100 to 500 parts by weight, per 100 parts by weight of the basic dye.

The support may include paper, plastic films, synthetic paper and the like, among which paper is preferred from the price and coating performance viewpoints.

In the invention, the method of forming the recording layer is not limited to any particular one but may include those techniques conventional and well-known in the art. Thus, for instance, the coating composition for heat-sensitive recording layer formation is applied to the support using an appropriate application device such as an air knife coater, blade coater, bar coater, gravure coater, curtain coater or short dwell coater, and the coated support is then dried. The amount of the coating composition to be applied is not critical, either, but, generally, it is adjusted within the range of 2 to 12 g/m$^2$, preferably 2 to 8 g/m$^2$, on the dry weight basis. Various additional techniques known in the field of heat-sensitive recording medium manufacture can be applied as required. Thus, for example, for protecting the recording layer and/or for other purposes, an overcoat layer may be provided on the recording layer. It is of course possible to provide a protective layer on the reverse side of the support and/or a undercoat layer between the support and heat-sensitive recording layer. It is further possible to provide the recording media with an adhesive layer.

EXAMPLES

The following examples illustrate the invention in further detail but, of course, are by no means limitative of the scope of the invention. In the examples, unless otherwise specified, "part(s)" and "%" are "part(s) by weight" and "% by weight", respectively.

Example I-1

(1) Preparation of Dispersion A

| | |
|---|---|
| 3-(N-Ethyl-N-isoamyl)amino-6-methyl-7-phenylaminofluoran | 10 parts |
| 5% Aqueous solution of methylcellulose | 5 parts |
| Water | 40 parts |

The mixture of the above components was pulverized in a sand mill to a mean particle size of 1.0 μm.

(2) Preparation of Dispersion B

| | |
|---|---|
| Benzyl 4-hydroxybenzoate | 20 parts |
| 5% Aqueous solution of methylcellulose | 5 parts |
| Water | 55 parts |

The mixture of the above components was pulverized in a sand mill to a mean particle size of 1.5 μm.

(3) Preparation of Dispersion C

| | |
|---|---|
| Sodium salt of 2,2'-methylenebis(4,6-di-tert-butylphenyl) phosphate | 3 parts |
| 5% Aqueous solution of methylcellulose | 3 parts |
| Water | 25 parts |

The mixture of the above components was pulverized in a sand mill to a mean particle size of 1.5 μm.

(4) Formation of recording layer

Fifty-five parts of Dispersion A, 80 parts of Dispersion B, 31 parts of Dispersion C, 15 parts of silicon dioxide pigment (oil absorption 180 ml/100g), 50 parts of 20% aqueous solution of polyvinyl alcohol and 10 parts of water were mixed with stirring. The coating composition thus obtained was applied to a base paper weighing 50 g/m$^2$ in an amount of 6 g/m$^2$ (on dry basis), followed by drying to give a heat-sensitive recording paper.

Example I-2

A heat-sensitive recording paper was produced in the same manner as in Example I-1 except that, in preparing Dispersion C, 2,2'-methylenebis(4,6-di-tert-butylphenyl) phosphate was used in lieu of the sodium salt of 2,2'-methylenebis(4,6-di-tert-butylphenyl) phosphate.

Example I-3

A heat-sensitive recording paper was produced in the same manner as in Example I-1 except that, in preparing Dispersion C, potassium salt of 2,2'-methylenebis(4,6-di-tert-butylphenyl) phosphate was used in lieu of the sodium salt of 2,2'-methylenebis(4,6-di-tert-butylphenyl) phosphate.

Example I-4

(1) Preparation of Dispersion D

| | |
|---|---|
| 3-(N-Ethyl-N-isoamyl)amino-6-methyl-7-phenylaminofluoran | 10 parts |
| 1,2-Bis(3-methylphenoxy)ethane | 25 parts |
| 5% Aqueous solution of methylcellulose | 5 parts |
| Water | 50 parts |

The mixture of the above components was pulverized in a sand mill to a mean particle size of 1.0 μm.

(2) Preparation of Dispersion E

| | |
|---|---|
| 4,4'-Isopropylidenediphenol | 20 parts |
| 5% Aqueous solution of methylcellulose | 5 parts |
| Water | 55 parts |

The mixture of the above components was pulverized in a sand mill to a mean particle size of 1.5 μm.

(3) Preparation of Dispersion F

| | |
|---|---|
| Mixture of sodium salt of 2,2'-methylenebis(4,6-di-tert-butylphenyl) phosphate and silica (mixing ratio = 60:40) | 6 parts |
| 5% Aqueous solution of methylcellulose | 3 parts |
| Water | 25 parts |

The mixture of the above components was pulverized in a sand mill to a mean particle size of 1 5 μm.

(4) Formation of recording layer

Ninety parts of Dispersion D, 80 parts of Dispersion E, 34 parts of Dispersion F, 15 parts of silicon dioxide pigment (oil absorption 180 ml/100 g), 50 parts of 20% aqueous solution of polyvinyl alcohol and 10 parts of water were mixed with stirring. The coating composition thus obtained was applied to a base paper weighing 50 g/m$^2$ in an amount of 6 g/m$^2$ (on dry basis), followed by drying to give a heat-sensitive recording paper.

Example I-5

A heat-sensitive recording paper was produced in the same manner as in Example I-4 except that, in preparing Dispersion F, a mixture of 2,2'-methylenebis(4,6-di-tert-butylphenyl) phosphate and silica (mixing ratio=60:40) was used in lieu of the mixture of sodium salt of 2,2'-methylenebis(4,6-di-tert-butylphenyl) phosphate and silica (mixing ratio=60:40).

Example I-6

A heat-sensitive recording paper was produced in the same manner as in Example I-4 except that, in preparing Dispersion E, 4-hydroxy-4,-isopropoxydiphenyl sulfone was used in lieu of 4,4'-isopropylidenediphenol.

Example I-7

A heat-sensitive recording paper was produced in the same manner as in Example I-1 except that, in preparing Dispersion A, 3-di-n-butylamino-6-methyl-7-phenylaminofluoran was used in lieu of 3-(N-ethyl-N-isoamyl)amino-6-methyl-7-phenylaminofluoran.

Example I-8

(1) Preparation of Dispersion G

| | |
|---|---|
| 3-Di-n-butylamino-6-methyl-7-phenylaminofluoran | 10 parts |
| 1,2-Bis(3-methylphenoxy)ethane | 25 parts |
| 5% Aqueous solution of methylcellulose | 5 parts |
| Water | 50 parts |

The mixture of the above components was pulverized in a sand mill to a mean particle size of 1.0 μm.

(2) Formation of recording layer

Ninety parts of Dispersion G, 80 parts of Dispersion E, 31 parts of Dispersion C, 15 parts of silicon dioxide pigment (oil absorption 180 ml/100 g), 50 parts of 20% aqueous solution of polyvinyl alcohol and 10 parts of water were mixed with stirring. The thus-obtained coating composition was applied to a base paper weighing 50 g/m$^2$ in an amount of 6 g/m$^2$ (on dry basis), followed by drying to give a heat-sensitive recording paper.

Example I-9

A heat-sensitive recording paper was produced in the same manner as in Example I-8 except that 34 parts of Dispersion F was used in lieu of 31 parts of Dispersion C.

Example I-10

(1) Preparation of Dispersion H

| | |
|---|---|
| 3-Di-n-butylamino-6-methyl-7-phenylaminofluoran | 10 parts |
| 1,2-Bis(phenoxy)ethane | 25 parts |
| 5% Aqueous solution of methylcellulose | 5 parts |
| Water | 50 parts |

The mixture of the above components was 1.0 μm.

(2) Formation of recording layer

Ninety parts of Dispersion H, 80 parts of Dispersion E, 31 parts of Dispersion C, 15 parts of silicon dioxide pigment (oil absorption 180 ml/100 g), 50 parts of 20% aqueous solution of polyvinyl alcohol and 10 parts of water were mixed with stirring. The coating composition thus obtained was applied to a base paper weighing 50 g/m$^2$ in an amount of 6 g/m$^2$ (on dry basis), followed by drying to give a heat-sensitive recording paper.

Example I-11

A heat-sensitive recording paper was produced in the same manner as in Example I-10 except that 34 parts of Dispersion F was used in lieu of 31 parts of Dispersion C.

Example I-12

(1) Preparation of Dispersion I

| | |
|---|---|
| 3-Di-n-butylamino-6-methyl-7-phenylaminofluoran | 10 parts |
| Dibenzyl oxalate | 25 parts |
| 5% Aqueous solution of methylcellulose | 5 parts |
| Water | 50 parts |

The mixture of the above components was pulverized in a sand mill to a mean particle size of 1.0 μm.

(2) Formation of recording layer

Ninety parts of Dispersion I, 80 parts of Dispersion E, 31 parts of Dispersion C, 15 parts of silicon dioxide pigment (oil absorption 180 ml/100 g), 50 parts of 20% aqueous solution of polyvinyl alcohol and 10 parts of water were mixed with stirring. The coating composition thus obtained was applied to a base paper weighing 50 g/m$^2$ in an amount of 6 g/m$^2$ (on dry basis), followed by drying to give a heat-sensitive recording paper.

Example I-13

A heat-sensitive recording paper was produced in the same manner as in Example I-12 except that 34 parts of Dispersion F was used in lieu of 31 parts of Dispersion C.

Example I-14

(1) Preparation of Dispersion J

| | |
|---|---|
| 3-Di-n-butylamino-6-methyl-7-phenylaminofluoran | 10 parts |
| Di(4-methylbenzyl) oxalate | 25 parts |
| 5% Aqueous solution of methylcellulose | 5 parts |
| Water | 50 parts |

The mixture of the above components was pulverized in a sand mill to a mean particle size of 1.0 μm.

(2) Formation of recording layer

Ninety parts of Dispersion J, 80 parts of Dispersion E, 31 parts of Dispersion C, 15 parts of silicon dioxide pigment (oil absorption 180 ml/100 g), 50 parts of 20% aqueous solution of polyvinyl alcohol and 10 parts of water were mixed with stirring. The coating composition thus obtained was applied to a base paper weighing 50 g/m$^2$ in an amount of 6 g/m$^2$ (on dry basis), followed by drying to give a heat-sensitive recording paper.

Example I-15

A heat-sensitive recording paper was produced in the same manner as in Example I-14 except that 34 parts of Dispersion F was used in lieu of 31 parts of Dispersion C.

Example I-16

(1) Preparation of Dispersion K

| | |
|---|---|
| 3-Di-n-butylamino-6-methyl-7-phenylaminofluoran | 10 parts |
| 1-(2-Methylphenoxy)-2-(4-methoxyphenoxy)ethane | 25 parts |
| 5% Aqueous solution of methylcellulose | 5 parts |
| Water | 50 parts |

The mixture of the above components was pulverized in a sand mill to a mean particle size of 1.0 μm.

(2) Formation of recording layer

Ninety parts of Dispersion K, 80 parts of Dispersion E, 31 parts of Dispersion C, 15 parts of silicon dioxide pigment (oil absorption 180 ml/100 g), 50 parts of 20% aqueous solution of polyvinyl alcohol and 10 parts of water were mixed with stirring. The coating composition thus obtained was applied to a base paper weighing 50 g/m$^2$ in an amount of 6 g/m$^2$ (on dry basis), followed by drying to give a heat-sensitive recording paper.

Example I-17

A heat-sensitive recording paper was produced in the same manner as in Example I-16 except that 34 parts of Dispersion F was used in lieu of 31 parts of Dispersion C.

Example I-18

(1) Preparation of Dispersion L

| | |
|---|---|
| 3-Di-n-butylamino-6-methyl-7-phenylaminofluoran | 10 parts |
| p-Benzylbiphenyl | 25 parts |
| 5% Aqueous solution of methylcellulose | 5 parts |
| Water | 50 parts |

The mixture of the above components was pulverized in a sand mill to a mean particle size of 1.0 μm.

(2) Formation of recording layer

Ninety parts of Dispersion L, 80 parts of Dispersion E, 31 parts of Dispersion C, 15 parts of silicon dioxide pigment (oil absorption 180 ml/100 g), 50 parts of 20% aqueous solution of polyvinyl alcohol and 10 parts of water were mixed with stirring. The thus-obtained coating composition was applied to a base paper weighing 50 g/m$^2$ in an amount of 6 g/m$^2$ (on dry basis), followed by drying to give a heat-sensitive recording paper.

Example I-19

A heat-sensitive recording paper was produced in the same manner as in Example I-18 except that 34 parts of Dispersion F was used in lieu of 31 parts of Dispersion C.

Example I-20

(1) Preparation of Dispersion M

| | |
|---|---|
| 3-Di-n-butylamino-6-methyl-7-phenylaminofluoran | 10 parts |
| 1,5-Bis(4-methoxyphenoxy)-3-oxa-pentane | 25 parts |
| 5% Aqueous solution of methylcellulose | 5 parts |
| Water | 50 parts |

The mixture of the above components was pulverized in a sand mill to a mean particle size of 1.0 μm.

(2) Formation of recording layer

Ninety parts of Dispersion M, 80 parts of Dispersion E, 31 parts of Dispersion C, 15 parts of silicon dioxide pigment (oil absorption 180 ml/100 g), 50 parts of 20% aqueous solution of polyvinyl alcohol and 10 parts of water were mixed with stirring. The thus-obtained coating composition was applied to a base paper weighing 50 g/m$^2$ in an amount of 6 g/m$^2$ (on dry basis), followed by drying to give a heat-sensitive recording paper.

Example I-21

A heat-sensitive recording paper was produced in the same manner as in Example I-20 except that 34 parts of Dispersion F was used in lieu of 31 parts of Dispersion C.

Example I-22

A heat-sensitive recording paper was produced in the same manner as in Example I-8 except that Dispersion C was used in an amount of 10 parts.

Example I-23

A heat-sensitive recording paper was produced in the same manner as in Example I-8 except that Dispersion C was used in an amount of 60 parts.

Example I-24

A heat-sensitive recording paper was produced in the same manner as in Example I-8 except that Dispersion C was used in an amount of 100 parts.

Example I-25

A heat-sensitive recording paper was produced in the same manner as in Example I-4 except that, in recording layer formation, 55 parts of Dispersion A was used in lieu of 90 parts of Dispersion D.

Example I-26

A heat-sensitive recording paper was produced in the same manner as in Example I-14 except that, in recording layer formation, precipitated calcium carbonate (oil absorption 90 ml/100 g) was used in lieu of the silicon dioxide pigment.

Example I-27

A heat-sensitive recording paper was produced in the same manner as in Example I-14 except that ammonium salt of 2,2'-methylenebis(4,6-di-tert-butylphenyl) phosphate was used in lieu of the sodium salt of 2,2'-methylenebis(4,6-di-tert-butylphenyl) phosphate.

Comparative Example I-1

A heat-sensitive recording paper was produced in the same manner as in Example I-1 except that Dispersion C was not used.

Comparative Example I-2

A heat-sensitive recording paper was produced in the same manner as in Example I-4 except that Dispersion F was not used.

Comparative Example I-3

A heat-sensitive recording paper was produced in the same manner as in Example I-6 except that Dispersion F was not used.

Comparative Example I-4

A heat-sensitive recording paper was produced in the same manner as in Example I-7 except that Dispersion C was not used.

Comparative Example I-5

A heat-sensitive recording paper was produced in the same manner as in Example I-8 except that Dispersion C was not used.

Comparative Example I-6

A heat-sensitive recording paper was produced in the same manner as in Example I-10 except that Dispersion C was not used.

Comparative Example I-7

A heat-sensitive recording paper was produced in the same manner as in Example I-12 except that Dispersion C was not used.

Comparative Example I-8

A heat-sensitive recording paper was produced in the same manner as in Example I-8 except that, in preparing Dispersion C, 1,1,3-tris(2-methyl-4-hydroxy-5-tert-butylphenyl)butane was used in lieu of the sodium salt of 2,2'-methylenebis(4,6-di-tert-butylphenyl) phosphate.

Comparative Example I-9

A heat-sensitive recording paper was produced in the same manner as in Example I-8 except that, in preparing Dispersion C, 4,4'-butylidenebis(6-tert-butyl-m-cresol) was used in lieu of the sodium salt of 2,2'-methylenebis(4,6-di-tert-butylphenyl) phosphate.

The thus-obtained 36 heat-sensitive recording papers were evaluated by the following methods. The results are shown in Table 1.

Color density of record images

Recording was carried out on each of the heat-sensitive recording papers, using a heat sensitive facsimile (Panafax UF-60; a product of Matsushita Graphic Communication Systems, Inc.) and the color density ($D_1$) of the record images was measured using a Macbeth densitometer (model RD-914; a product of Macbeth Corp.).

Moisture resistance of record images

After recording, each heat-sensitive recording paper was allowed to stand in an atmosphere maintained at 40° C. and 90% RH for 24 hours and then the color density ($D_2$) of the record images was measured using the Macbeth densitometer. The residual color density percentage (%) was calculated as follows:

Residual color density percentage $=(D_2/D_1)\times 100$

Heat resistance of record images

Each heat-sensitive recording paper after recording was allowed to stand in an atmosphere maintained at 60° C. and 10% RH for 24 hours and then the color density ($D_3$) of the record images was measured using the Macbeth densitometer. The residual color density percentage (%) was calculated as follows:

Residual color density percentage $=(D_3/D_1)\times 100$

Whiteness

The whiteness of each heat-sensitive recording paper before recording was measured using a Hunter whiteness meter.

Fogging

Each heat-sensitive recording paper was allowed to stand in an atmosphere maintained at 40° C. and 90% RH or in an atmosphere maintained at 60° C. and 10% RH for 24 hours and then the fog color density of the white portion was measured using the Macbeth densitometer. In Table 1, the fog color density data obtained after treatment in the 40° C. and 90% RH atmosphere are shown in the column headed $F_1$, and those obtained after treatment in the 60° C. and 10% RH atmosphere in the column headed $F_2$.

TABLE 1

| | Color density | | | Residual color density percentage | | | Fogging | |
|---|---|---|---|---|---|---|---|---|
| | $D_1$ | $D_2$ | $D_3$ | $D_2/D_1$ | $D_3/D_1$ | Whiteness | $F_1$ | $F_2$ |
| Example I-1 | 1.29 | 0.97 | 1.07 | 75 | 83 | 86.3 | 0.10 | 0.16 |
| Example I-2 | 1.28 | 0.95 | 1.06 | 74 | 83 | 86.2 | 0.11 | 0.17 |
| Example I-3 | 1.28 | 0.95 | 1.05 | 74 | 82 | 86.5 | 0.11 | 0.16 |
| Example I-4 | 1.35 | 1.30 | 1.22 | 96 | 90 | 82.6 | 0.12 | 0.16 |
| Example I-5 | 1.31 | 1.24 | 1.19 | 95 | 91 | 82.5 | 0.11 | 0.16 |
| Example I-6 | 1.25 | 1.22 | 1.23 | 98 | 98 | 85.2 | 0.10 | 0.11 |
| Example I-7 | 1.28 | 0.91 | 1.02 | 71 | 80 | 86.3 | 0.09 | 0.08 |
| Example I-8 | 1.33 | 1.12 | 1.09 | 84 | 82 | 85.7 | 0.08 | 0.08 |
| Example I-9 | 1.32 | 1.12 | 1.10 | 85 | 83 | 85.7 | 0.08 | 0.09 |
| Example I-10 | 1.34 | 1.11 | 1.09 | 83 | 81 | 85.6 | 0.09 | 0.10 |
| Example I-11 | 1.35 | 1.15 | 1.12 | 85 | 83 | 85.4 | 0.09 | 0.11 |
| Example I-12 | 1.34 | 1.13 | 1.07 | 84 | 80 | 85.1 | 0.11 | 0.12 |
| Example I-13 | 1.35 | 1.15 | 1.09 | 85 | 81 | 85.2 | 0.10 | 0.12 |
| Example I-14 | 1.29 | 1.21 | 1.17 | 94 | 91 | 84.7 | 0.09 | 0.10 |
| Example I-15 | 1.25 | 1.19 | 1.14 | 95 | 91 | 84.5 | 0.09 | 0.10 |
| Example I-16 | 1.38 | 1.28 | 1.20 | 93 | 87 | 85.0 | 0.10 | 0.16 |
| Example I-17 | 1.37 | 1.27 | 1.21 | 93 | 88 | 85.3 | 0.10 | 0.16 |
| Example I-18 | 1.24 | 0.93 | 0.98 | 75 | 79 | 83.7 | 0.08 | 0.13 |
| Example I-19 | 1.21 | 0.91 | 0.97 | 75 | 80 | 83.5 | 0.08 | 0.13 |
| Example I-20 | 1.27 | 1.12 | 1.07 | 88 | 84 | 84.4 | 0.08 | 0.13 |
| Example I-21 | 1.23 | 1.09 | 1.05 | 89 | 85 | 83.9 | 0.08 | 0.13 |
| Example I-22 | 1.33 | 1.08 | 1.05 | 81 | 79 | 85.7 | 0.08 | 0.08 |
| Example I-23 | 1.32 | 1.15 | 1.15 | 87 | 87 | 85.0 | 0.10 | 0.09 |
| Example I-24 | 1.32 | 1.12 | 1.19 | 85 | 90 | 83.0 | 0.13 | 0.14 |
| Example I-25 | 0.78 | 0.64 | 0.70 | 82 | 90 | 85.6 | 0.09 | 0.08 |
| Example I-26 | 1.28 | 1.23 | 1.22 | 96 | 95 | 86.5 | 0.07 | 0.07 |
| Example I-27 | 1.28 | 1.20 | 1.18 | 94 | 92 | 83.8 | 0.10 | 0.11 |
| Comparative Example I-1 | 1.27 | 0.42 | 0.77 | 33 | 61 | 86.8 | 0.10 | 0.17 |
| Comparative Example I-2 | 1.31 | 1.16 | 0.93 | 89 | 71 | 84.6 | 0.12 | 0.14 |
| Comparative Example I-3 | 1.25 | 1.05 | 0.79 | 84 | 63 | 85.9 | 0.09 | 0.10 |
| Comparative Example I-4 | 1.28 | 0.34 | 0.70 | 27 | 55 | 86.4 | 0.09 | 0.08 |

TABLE 1-continued

| | Color density | | | Residual color density percentage | | | Fogging | |
|---|---|---|---|---|---|---|---|---|
| | $D_1$ | $D_2$ | $D_3$ | $D_2/D_1$ | $D_3/D_1$ | Whiteness | $F_1$ | $F_2$ |
| Comparative Example I-5 | 1.33 | 1.00 | 0.74 | 75 | 56 | 85.7 | 0.08 | 0.08 |
| Comparative Example I-6 | 1.34 | 1.02 | 0.71 | 76 | 53 | 85.5 | 0.09 | 0.09 |
| Comparative Example I-7 | 1.33 | 0.93 | 0.67 | 70 | 50 | 85.2 | 0.11 | 0.14 |
| Comparative Example I-8 | 1.34 | 1.01 | 0.81 | 75 | 60 | 83.5 | 0.10 | 0.10 |
| Comparative Example I-9 | 1.33 | 1.00 | 0.75 | 75 | 56 | 84.2 | 0.09 | 0.09 |

As is evident from the results shown in Table 1, the heat-sensitive recording media of the present invention were excellent in storage stability of record images and were almost free from fogging which tends to accompany the improvements in storage stability.

Example II-1

(1) Preparation of Dispersion A

| | |
|---|---|
| 3-Di-n-butylamino-6-methyl-7-phenylaminofluoran | 10 parts |
| 1,2-Bis(3-methylphenoxy)ethane | 25 parts |
| 5% Aqueous solution of methylcellulose | 5 parts |
| Water | 50 parts |

The mixture of the above components was pulverized in a sand mill to a mean particle size of 1.0 μm.

(2) Preparation of Dispersion B

| | |
|---|---|
| 4,4'-Isopropylidenediphenol | 20 parts |
| 5% Aqueous solution of methylcellulose | 5 parts |
| Water | 55 parts |

The mixture of the above components was pulverized in a sand mill to a mean particle size of 1.5 μm.

(3) Preparation of Dispersion C

| | |
|---|---|
| Sodium salt of 2,2'-methylenebis(4,6-di-tert-butylphenyl) phosphate | 3.9 parts |
| Magnesium silicate | 2.1 parts |
| 5% Aqueous solution of sulfone group-modified polyvinyl alcohol [Gohseran L-3266 (trademark); a product of Nippon Synthetic Chemical Industry Co., Ltd.] | 3 parts |
| Water | 25 parts |

The mixture of the above components was pulverized in a sand mill to a mean particle size of 1.5 μm. It was confirmed that the mixture after pulverization contained magnesium salt of 2,2'-methylenebis(4,6-di-tert-butylphenyl) phosphate as resulting from salt exchange.

(4) Formation of recording layer

Ninety parts of Dispersion A, 80 parts of Dispersion B, 34 parts of Dispersion C, 7 parts of silicon dioxide pigment (oil absorption 180 ml/100 g), 8 parts of precipitated calcium carbonate (oil absorption 90 ml/100 g), 50 parts of 20% aqueous solution of polyvinyl alcohol, 15 parts of 30% aqueous dispersion of zinc stearate and 10 parts of water were mixed with stirring. The thus-obtained coating composition was applied to a base paper weighing 50 g/m$^2$ in an amount of 6 g/m$^2$ (on dry basis), followed by drying to give a heat-sensitive recording paper.

Example II-2

A heat-sensitive recording paper was produced in the same manner as in Example II-1 except that, in preparing Dispersion C, calcium silicate was used in lieu of magnesium silicate.

Example II-3

A heat-sensitive recording paper was produced in the same manner as in Example II-1 except that, in preparing Dispersion A, 3-di-n-butylamino-7-(o-chlorophenylamino)fluoran was used in lieu of 3-di-n-butylamino-6-methyl-7-phenylaminofluoran, and that di(4-methylbenzyl) oxalate was used in lieu of 1,2-bis(3-methylphenoxy)ethane and that, in preparing Dispersion C, a 1:1 mixture of magnesium silicate and calcium carbonate was used in lieu of magnesium silicate.

Example II-4

A heat-sensitive recording paper was produced in the same manner as in Example II-3 except that, in preparing Dispersion A, dibenzyl oxalate was used in lieu of di(4-methylbenzyl) oxalate, and that, in preparing Dispersion B, 4-hydroxy-4'-isopropoxydiphenyl sulfone was used in lieu of 4,4'-isopropylidenediphenol and that, in preparing Dispersion C, a 1:1 mixture of zinc chloride and calcium carbonate was used in lieu of the 1:1 mixture of magnesium silicate and calcium carbonate.

Example II-5

A heat-sensitive recording paper was produced in the same manner as in Example II-1 except that, in preparing Dispersion C, 3 parts of 5% aqueous solution of methylcellulose was used in lieu of 3 parts of 5% aqueous solution of sulfone group-modified polyvinyl alcohol.

Example II-6

A heat-sensitive recording paper was produced in the same manner as in Example II-1 except that, in recording layer formation, 15 parts of silicone dioxide pigment (oil absorption 180 ml/100 g) was used in lieu of the combination of 7 parts of silicon dioxide pigment and 8 parts of precipitated calcium carbonate.

Example II-7

A heat-sensitive recording paper was produced in the same manner as in Example II-1 except that, in recording layer formation, 8 parts of magnesium carbonate was used in lieu of 8 parts of precipitated calcium carbonate.

Comparative Example II-1

A heat-sensitive recording paper was produced in the same manner as in Example II-1 except that, in preparing Dispersion C, 6 parts of 1,1,3-tris(5-cyclohexyl-4-hydroxy-2-methylphenyl)butane was used in lieu of the combination of sodium salt of 2,2'-methylenebis(4,6-di-tert-butylphenyl) phosphate and magnesium silicate.

The thus-produced eight heat-sensitive recording papers were evaluated by the following methods. The results obtained are shown in Table 2.

Color density of record images

Each heat-sensitive recording paper was subjected to recording on a heat-sensitive recording paper color development tester (a product of Okura Electric Co., Ltd.; model TH-PMD; applied voltage: 16 V; pulse cycle: 0.51 ms) at a pulse width of 0.30 ms, and the color density ($D_1$) was measured using a Macbeth densitometer (model RD-914, a product of Macbeth Corp.).

Moisture resistance of record images

Each heat-sensitive recording paper after recording was allowed to stand in an atmosphere maintained at 40° C. and 90% RH for 48 hours and the color density ($D_2$) of the record images was again measured using the Macbeth densitometer. The residual color density percentage (%) was calculated as follows:

Residual color density percentage $=(D_2/D_1)\times 100$

Heat resistance of record images

Each heat-sensitive recording paper after recording was allowed to stand in an atmosphere maintained at 60° C. and 10% RH for 48 hours and the color density ($D_3$) of the record image portions was again measured using the Macbeth densitometer. The residual color density percentage (%) was calculated as follows:

Residual color density percentage $=(D_3/D_1)\times 100$

Whiteness

The whiteness of each heat-sensitive recording paper before recording was measured using a Hunter whiteness meter.

Fogging

Each heat-sensitive recording paper was allowed to stand in an atmosphere maintained at 40° C. and 90% RH, or 60° C. and 10% RH, for 48 hours, and the resultant fog color density of the white portion was measured using the Macbeth densitometer. In Table 2, the fog color density data after treatment in the 40° C. and 90% RH atmosphere are shown in the column headed $F_1$ and those after treatment in the 60° C. and 10% RH atmosphere are shown in the column headed $F_2$.

Adhesion of residual substances

Three heat-sensitive recording papers having a size of A4 was subjected to 100% recording on a heat-sensitive recording paper color development tester (a product of Okura Electric Co., Ltd.; model TH-PMD; applied voltage: 16 V; pulse cycle: 0.51 ms) with a pulse width of 0.30 ms. Then, the quantity of residual substances in the vicinity of the thermal head was evaluated.

Evaluation criteria

A: Almost no adhesion of residual substances.

B: Adhesion of residual substances in small amounts but no practical problem.

C: Significant adhesion of residual substances.

TABLE 2

| | Color density | | | Residual color density percentage | | Whiteness | Fogging | | Residual substances adhesion |
|---|---|---|---|---|---|---|---|---|---|
| | $D_1$ | $D_2$ | $D_3$ | $D_2/D_1$ | $D_3/D_1$ | | $F_1$ | $F_2$ | |
| Example II-1 | 1.33 | 1.10 | 1.06 | 83 | 80 | 85 | 0.10 | 0.11 | A |
| Example II-2 | 1.33 | 1.12 | 1.08 | 84 | 81 | 84 | 0.10 | 0.12 | A |
| Example II-3 | 1.30 | 1.13 | 1.11 | 87 | 85 | 85 | 0.10 | 0.12 | A |
| Example II-4 | 1.28 | 1.14 | 1.10 | 89 | 86 | 83 | 0.13 | 0.14 | A |
| Example II-5 | 1.32 | 1.07 | 1.03 | 81 | 78 | 84 | 0.11 | 0.12 | B |
| Example II-6 | 1.34 | 1.10 | 1.06 | 82 | 79 | 80 | 0.13 | 0.14 | A |
| Example II-7 | 1.32 | 1.10 | 1.06 | 83 | 80 | 86 | 0.09 | 0.10 | A |
| Comparative Example II-1 | 1.27 | 0.80 | 0.68 | 63 | 54 | 84 | 0.08 | 0.10 | C |

As is evident from the results shown in Table 2, the heat-sensitive recording media according to the invention were superior in storage stability of record images and were substantially free from adhesion of residual substances which tends to accompany the improvements in storage stability.

We claim:

1. A heat-sensitive recording medium comprising (a) a support and (b) a heat-sensitive recording layer formed on the support and comprising a colorless or pale-colored basic dye and a color developing material capable of causing color development upon contact with the dye by heating, which medium is characterized in that the heat-sensitive recording layer contains at least one phosphate compound selected from the group consisting of 2,2'-methylenebis(4,6-di-tert-butylphenyl) phosphate of the general formula (1) shown below and alkali metal, ammonium and polyvalent metal salts thereof:

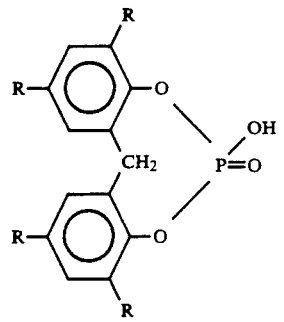

(1)

wherein R represents a tert-butyl group and at least one alkaline pigment in an amount of 3 to 15% by weight based on the total solids contained in the recording layer.

2. A heat-sensitive recording medium as claimed in claim 1, wherein said phosphate compound is 2,2'- methylenebis(4,6-di-tert-butylphenyl) phosphate or an alkali metal salt thereof.

3. A heat-sensitive recording medium as claimed in claim 2, wherein said alkali metal salt is the sodium or potassium salt.

4. A heat-sensitive recording medium as claimed in claim 1, wherein said phosphate compound is a polyvalent metal salt of 2,2'-methylenebis(4,6-di-tert-butylphenyl) phosphate.

5. A heat-sensitive recording medium as claimed in claim 4, wherein said polyvalent metal salt is the magnesium, calcium, barium, zinc or aluminum salt.

6. A heat-sensitive recording medium as claimed in claim 4, wherein said polyvalent metal salt is used in the form of a mixture of at least two polyvalent metal salts.

7. A heat-sensitive recording medium as claimed in claim 1, wherein said phosphate compound is used in an amount of about 1 to 300 parts by weight per 100 parts by weight of the color developing material.

8. A heat-sensitive recording medium as claimed in claim 1, wherein the heat-sensitive recording layer further contains at least one heat-fusible substance.

9. A heat-sensitive recording medium as claimed in claim 8, wherein said heat-fusible substance is at least one member selected from the group consisting of 1,2-bis(3-methylphenoxy)ethane, 1,2-bis(phenoxy)ethane, 1-(2-methylphenoxy)-2-(4-methoxyphenoxy)ethane, dibenzyl oxalate, di(4-methylbenzyl) oxalate, di(4-chlorobenzyl) oxalate, p-benzylbiphenyl, p-(4-tolyloxy)biphenyl and 1,5-bis(4-methoxyphenoxy)-3-oxapentane.

10. A heat-sensitive recording medium as claimed in claim 8, wherein said heat-fusible substance is used in an amount of about 50 to 1,000 parts by weight per 100 parts of the basic dye.

11. A heat-sensitive recording medium as claimed in claim 1, wherein said alkaline pigment is calcium carbonate, magnesium carbonate, calcium silicate or magnesium silicate.

12. A heat-sensitive recording medium as claimed in claim 11, wherein said alkaline pigment is calcium carbonate or magnesium carbonate.

13. A heat-sensitive recording medium as claimed in claim 12, wherein said alkaline pigment is calcium carbonate.

* * * * *